United States Patent [19]

Gagnon

[11] Patent Number: 4,625,140

[45] Date of Patent: Nov. 25, 1986

[54] TUNGSTEN HALOGEN LAMP WITH LIGHT SOURCE CAPSULE CONTAINMENT DEVICE

[75] Inventor: Peter R. Gagnon, Georgetown, Mass.

[73] Assignee: GTE Products Corporation, Stamford, Conn.

[21] Appl. No.: 741,717

[22] Filed: Jun. 6, 1985

Related U.S. Application Data

[63] Continuation of Ser. No. 422,311, Sep. 23, 1982, abandoned.

[51] Int. Cl.[4] ..... H01K 1/34; H01K 1/50

[52] U.S. Cl. ..... 313/25; 313/579; 313/580; 362/186

[58] Field of Search ..... 313/25, 315, 573, 578–580, 313/634; 362/186; 220/2.1 R

[56] References Cited

U.S. PATENT DOCUMENTS

| | | | |
|---|---|---|---|
| 314,208 | 3/1885 | White | 313/113 X |
| 3,148,835 | 9/1964 | Horelick | 240/46.51 |
| 3,223,273 | 12/1965 | Thorington | 220/2.1 R |
| 4,281,274 | 7/1981 | Bechard et al. | 313/578 X |
| 4,338,540 | 7/1982 | Sovilla | 313/579 |

FOREIGN PATENT DOCUMENTS

| | | |
|---|---|---|
| 849331 | 11/1939 | France . |
| 852426 | 2/1940 | France . |

*Primary Examiner*—Palmer C. DeMeo
*Assistant Examiner*—Sandra L. O'Shea
*Attorney, Agent, or Firm*—Joseph S. Romanow; William H. McNeill

[57] ABSTRACT

A double-enveloped tungsten halogen incandescent lamp having a light-source capsule containment device wherein a knitted wire mesh surrounds the light-source capsule and may be anchored to the capsule, stem, or lead-in wires. In the event of a burst of the light-source capsule, the containment mesh substantially restricts shards of the capsule from shattering the outer envelope of the lamp. In some embodiments, a crumpled portion of the containment mesh is positioned above the capsule and provides a collision-absorbing cushion in the event the capsule and mesh are propelled against the outer envelope by the burst of the light-source capsule whereby further protection against the shattering of the outer envelope is provided. Lamps with such containment devices have improved operational safety characteristics.

12 Claims, 6 Drawing Figures

TUNGSTEN HALOGEN LAMP WITH LIGHT SOURCE CAPSULE CONTAINMENT DEVICE

This application is a continuation of application Ser. No. 422,311, filed Sept. 23, 1982, assigned to the same assignee as the parent application and now abandoned.

CROSS REFERENCES TO RELATED APPLICATIONS

U.S. applications Ser. Nos. 744,645, filed June 13, 1985, a continuation of Ser. No. 422,312, filed Sept. 23, 1982 now abandoned and Ser. No. 422,313, filed Sept. 23, 1982 all assigned to the assigned hereof, certain related subject matter.

TECHNICAL FIELD

This invention relates to double-enveloped tungsten halogen incandescent lamps employing light-source capsule containment devices.

BACKGROUND ART

There is a small probability that a double-enveloped tungsten halogen incandescent lamp will burst during operation of the lamp, hereinafter called a "containment failure" of the lamp. When a lamp containment failure occurs, the sequence of events internal to the lamp is as follows. The tungsten halogen capsule bursts causing fragments of glass or shards to be propelled against the outer envelope; these shards shatter the outer envelope of the lamp. The external result is that the lamp bursts. It is this type of lamp failure that is the subject of this disclosure.

One type of containment failure which may occur in a lamp having a single-ended light-source capsule is as follows. The capsule ruptures near or in the press seal. The remainder or upper body of the capsule remains intact. Because of the release of substantial pressure from within the capsule, the capsule body (still referred to herein as a shard) is propelled away from the press seal toward the outer envelope. The outer envelope is shattered by the impact of the propelled capsule body.

The causes of these infrequent lamp failures are varied and unpredictable. There is no known way to eliminate the possibility of such failures. Although occurrence of the failure is rare, nevertheless it could present a safety hazard to a person in the immediate vicinity of a lamp. Where such failures can be anticipated, lamp manufacturers notify users by means of warnings on packages and other descriptive materials and by suggested precautions in specifications. This hazard may be avoided by operating the lamp in a fixture designed to contain such a failure. The requirement that the lamp be operated in a protective fixture is frequently employed in commercial usage. However, this procedural safeguard is less acceptable for consumer usage. For reasons of safety, economy, and convenience in both commercial and consumer usage, it may be desirable to incorporate a reliable containment device as part of the lamp itself.

As used herein, the terms "light-source capsule" or "capsule" denote a tungsten halogen incandescent light-generating capsule of a double-enveloped tungsten halogen lamp. This type of lamp, with single-ended and double-ended capsules, has been suggested in the prior art. U.S. Pat. Nos. 3,194,625, by Danko, issued July 13, 1965; 3,448,321, by Shanks, issued June 3, 1969; and 3,515,930, by Walsh et al, issued June 2, 1970, provide examples of tungsten halogen lamps of both the single-ended and double-ended capsule varieties.

The terms "efficacy" or "luminous efficacy" used herein are a measure, expressed in lumens per watt, of the total luminous flux emitted by a light source over all wavelengths divided by the power input of the source.

For a general reference on the tungsten halogen incandescent lamp, see IES Lighting Handbook, 1981 Reference Volume, Section 8.

In U.S. Pat. No. 4,281,274, issued July 28, 1981, by Bechard et al, there is disclosed an enclosure of glass surrounding the arc tube within the outer envelope of an arc discharge lamp. The enclosure is suggested as being useful as a means to protect against a containment failure of the lamp. While such enclosure may be effective in containing some arc tube bursts, it has been found that in a substantial percentage of cases the enclosure itself is shattered by the burst and containment failure of the lamp follows. Thus, the glass enclosure device taught in the Bechard et al patent offers only limited protection against lamp-containment failures, and such protection is especially tenuous in lamps having light-source capsules in which operating pressures may be as high as 20 atmospheres.

DISCLOSURE OF THE INVENTION

It is, therefore, an object of this invention to obviate the deficiencies in the prior art.

It is another object of this invention to improve the operating safety characteristics of tungsten halogen lamps.

These objects are accomplished, in one aspect of the invention, by the provision of a double-enveloped tungsten halogen incandescent lamp having a light-source capsule containment device. The lamp comprises an outer envelope, a light-source capsule, a stem, a containment mesh, and mesh-mounting means. The light-source capsule is mounted within the outer envelope on the stem. The containment mesh is mounted operatively via the mesh-mounting means within the outer envelope such that it substantially surrounds the light-source capsule. The containment mesh has the ability to absorb substantial energy upon deformation thereof by a capsule burst. The containment mesh has a minimal effect on the efficacy of the lamp. The flare of the stem is hermetically sealed to the outer envelope.

In the event of a containment failure of the lamp, the containment mesh absorbs burst energy and restricts shards of the light-source capsule from shattering the outer envelope.

These objects are further accomplished, in another aspect of the invention, by the provision of a double-enveloped tungsten halogen incandescent lamp having a light-source capsule containment device. The lamp comprises an outer envelope, a light-source capsule, a stem, a containment mesh, mesh-mounting means, and collision-absorbing means. The light-source capsule is single-ended, such capsule comprising a top and opposed base, with the base including a press seal. The light-source capsule is mounted within the outer envelope on the stem. The containment mesh is mounted operatively via the mesh-mounting means within the outer envelope such that it substantially surrounds the light-source capsule. The containment mesh has the ability to absorb substantial energy upon deformation thereof by the capsule burst. The containment mesh has a minimal effect on the efficacy of the lamp. The collision-absorbing means is mounted within the outer envelope above the top of the light-source capsule. The flare of the stem is hermetically sealed to the outer envelope.

In the event of a containment failure of the lamp, the containment mesh absorbs burst energy and restricts shards of the light-source capsule from shattering the outer envelope. The outer envelope may be further protected from being shattered by the collision-absorbing means which absorbs and dissipates the energy of impact in the event the light-source capsule or a substantial part thereof and the containment mesh are propelled against the outer envelope immediately following the burst of the light-source capsule.

Lamps with light-source capsule containment devices constructed in accordance with the foregoing description will exhibit substantially improved operating safety characteristics when compared to lamps of the prior art.

BEST MODE FOR CARRYING OUT THE INVENTION

For a better understanding of the present invention, together with other and further objects, advantages, and capabilities thereof, reference is made to the following disclosure and appended claims taken in conjunction with the above-described drawings.

Figure 1:
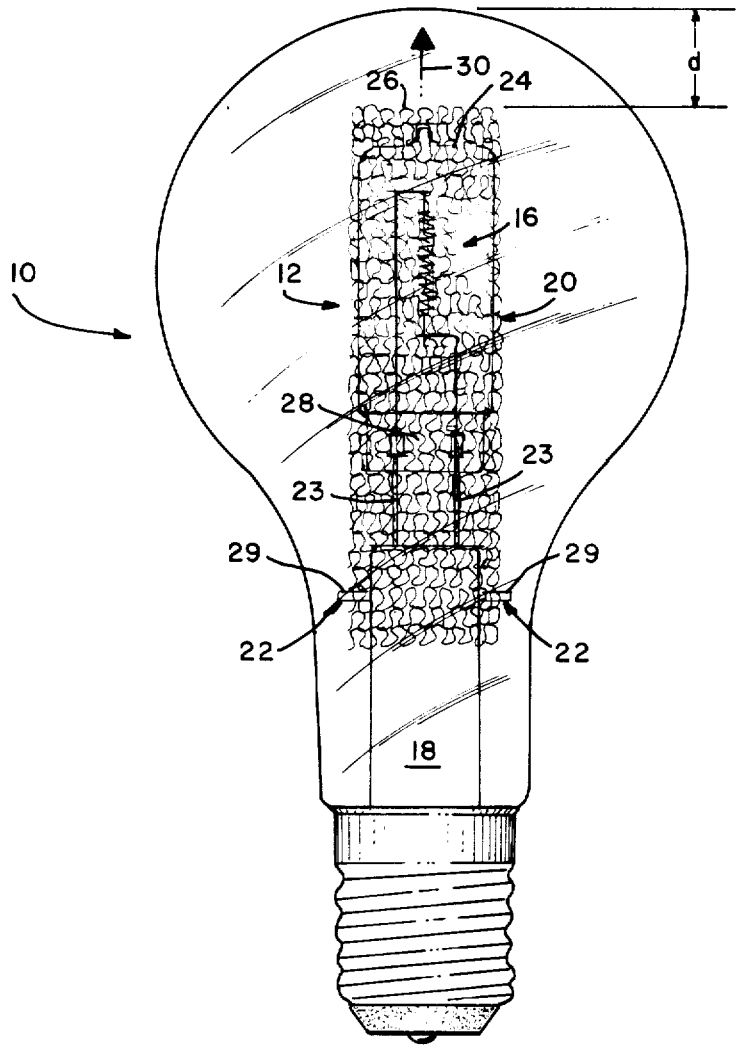
FIG. 1 is an elevational view of a tungsten halogen lamp employing an embodiment of the invention, with some parts broken away for clarity.

Referring to the drawings with greater particularity, FIG. 1 shows a double-enveloped tungsten halogen incandescent lamp 10 having a light-source capsule containment device 12. Lamp 10 comprises outer envelope 14, light-source capsule 16, stem 18, containment mesh 20, and mesh mounting means 22. Capsule 16 is mounted on stem 18 by means of stiff lead-in wires 23 which protrude from stem 18. In this embodiment, mesh 20 comprises knitted metal wire which forms a cylindrical sleeve which is closed at mesh top 26. Mesh 20 encloses capsule 16 laterally and about capsule-top 24. Mesh 20 may be formed into such a closed cylindrical sleeve by means of being knitted, self-welded, clamped, etc. More than one method may be used in the construction of containment mesh 20, such as knitting the mesh into a cylindrical sleeve and closing mesh-top 26 by welding or clamping. Mounting means 22 for containment mesh 20 comprises anchoring pins 29. Mesh 20, in sleeve form, is mounted by slipping the open end of the sleeve over capsule 16 and a portion of stem 18 such that anchoring pins 29 fit through respective stitches of mesh 20. Anchoring pins 29 should be inserted into stitches of mesh 20 which are sufficiently distant from the edge of the fabric so that the fabric will not tear in the event a force is exerted on mesh 20 in the direction of arrow 30. The distance between mesh-top 26 and outer envelope 14, as shown by distance d in the drawing, is greater than the maximum stretch of mesh 20 in the direction of arrow 30. The flare of stem 18, not shown in the drawing, is hermetically sealed to outer envelope 14.

In the event capsule 16 bursts, mesh 20 will absorb and contain a substantial portion of the energy emanating from such burst. In particular, mesh 20 will restrict shards of capsule 16 from shattering outer envelope 14. If capsule 16 fractures such that a substantial portion of capsule 16 is propelled in the direction of arrow 30, mesh 20 will contain capsule 16 and prevent it from shattering outer envelope 14 because mesh 20 is anchored to stem 18 and distance d exceeds the maximum possible extension of mesh 20. Thus, the protection against a containment failure of a tungsten halogen lamp has been significantly improved.

In some embodiments, containment mesh 20 is knitted. In other eabodiments, containment mesh 20 may be rigid. In some embodiments, the knitted mesh may be preferred because of its superior energy-containing capability; in other embodiments, the rigid mesh may be preferred because of its tractability.

It is desirable that the mesh be as light-transmissive as possible so that there will be a minimal effect on the efficacy of the lamp. A certain percentage of light will be reflected by the mesh on the light's first pass through the capsule. A portion of the reflected light will be unobstructed by the mesh on the reflected light's subsequent pass or passes through the capsule. Thus, the net reduction in luminous efficacy is less than would be expected by estimating the percentage of the area of the capsule covered by the mesh. In all observed cases, efficacy was reduced by less than 7% due to the presence of the mesh. This efficacy loss can be reduced to less than 6% by electropolishing the mesh. Because of the partial diffusion caused by the mesh, there is reduced glare from the lamp.

The mesh size, i.e., the number of stitches per inch, should be selected such that the mesh will contain shards with mass large enough to be likely to cause a rupture of the outer envelope in the event of a burst of the light-source capsule. The selection of mesh size is dependent on many factors, such as the type of lamp, the properties of the light-source capsule, the atmosphere within the capsule, the type of mesh, the diameter and tensile strength of the strand or strands in the mesh, etc.

In embodiments where a wire mesh is employed, there is the possibility of an electrical short circuit caused by contact of the wire mesh with both lead-in wires. Where this possibility is a concern, one or both lead-in wires can be insulated by means of a dielectric sleeve or coating; also, one or both lead-in wires may contain a fuse as an additional precaution.

In the embodiment shown in FIG. 1, containment mesh 20 is mounted to stem 18 by means of anchoring pins 29. In some embodiments, a single anchoring pin or clamp may suffice. Another feasible mounting means would be to wrap a strap tightly around mesh 20 and stem 18. Still another mounting means may be to weld or clamp the mesh to one or both lead-in wires 23 provided one or both lead-in wires 23 have been properly insulated against the possibility of an electrical short circuit.

The selection of construction material for the containment mesh is heavily influenced by the environment within the outer envelope during operation of the lamp and immediately following a burst of the light-source capsule. During lamp operation, the temperature about the mesh may be in excess of 200° C. Stainless-steel wire with a high chromium content is a preferred material for the construction of the mesh and mounting strap or straps because of its superior high-temperature properties, relatively low coefficient of thermal expansion, good resistance to oxidation and corrosion, and high tensile strength.

Several example lamps of the type shown in FIG. 1 were constructed. Mesh sizes ranged from 7 to 20 stitches per inch. Each containment mesh was knitted into a cylindrical sleeve from a single strand of stainless-steel wire having a diameter of 0.005 inches. Closure of the top of the mesh was accomplished by welding a strap of nickel across the mesh top. The light-source capsules were sealed into A 21 bulbs such that the distance between the top of the mesh and the outer envelope was approximately one-half inch. Internal capsule pressures were approximately 7–10 atmospheres when the lamp was cold; operating capsule pressures were in the 15–20 atmospheres range.

Figure 2:
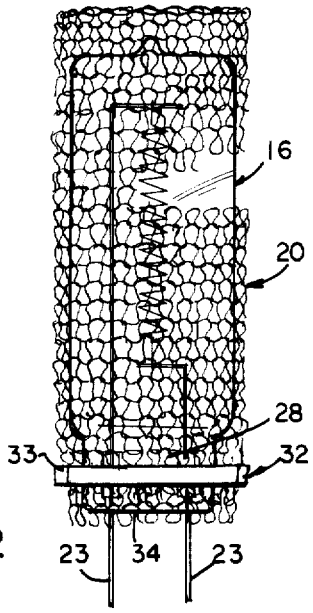
FIG. 2 is an elevational view of a single-ended light-source capsule illustrating an alternate embodiment of the invention, with parts broken away for clarity.

FIG. 2 shows an elevational view of light-source capsule 16, containment mesh 20, and mesh-mounting means 32. In this embodiment, mesh 20 is mounted directly on capsule 16 by means of strap 33 which is tightly wrapped around mesh 20 and press seal 28 of capsule 16. Alternate mounting means would be to clamp mesh 20 together below capsule-base 34 or to clamp mesh 20 to one or both lead-in wires 23. If either of the alternate mesh-mounting means are employed, one or both lead-in wires 23 should be insulated with a dielectric sleeve or coating in order to prevent a possible electrical short circuit caused by the wire mesh coming in contact with both lead-in wires 23.

Figure 3:
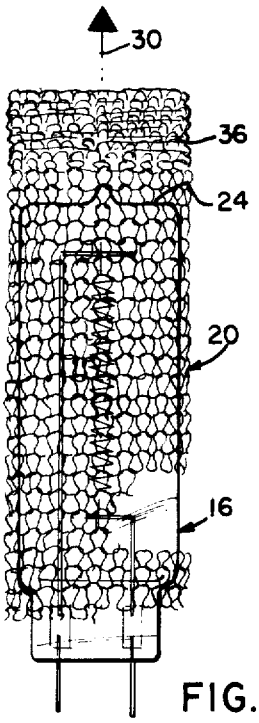
FIG. 3 is an elevational view of a single-ended light-source capsule illustrating another embodiment of the invention, with certain parts omitted for clarity.

In FIG. 3, mesh 20 is mounted directly on capsule 16 by means of elastic or frictional forces exerted against the body of capsule 16 by mesh 20 itself. With the frictional mounting means, mesh 20 may not be anchored sufficiently to insure against the possibility of a substantial portion of capsule 16 and mesh 20 being propelled in the direction of arrow 30 and impacting with the outer envelope of the lamp. If this collision should occur, collision-absorbing means 36 acts as a cushion and prevents the shattering of the outer envelope. In this embodiment, collision-absorbing means 36 is a slightly crumpled portion of mesh 20 positioned above capsule-top 24.

Figure 4:
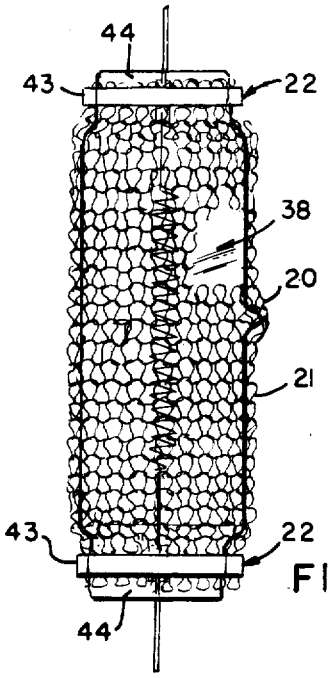
FIG. 4 is an elevational view of a double-ended light-source capsule employing an embodiment of the invention, with certain parts omitted for clarity.

In FIG. 4, a double-ended light-source capsule 38 has containment mesh 20 secured thereto by mesh-mounting means 22. In this embodiment, containment mesh 20 is a knitted cylindrical sleeve 21, and mesh-mounting means 22 comprises straps 43 which are tightly wrapped around sleeve 21 and press seals 44 of capsule 38.

Figure 5:
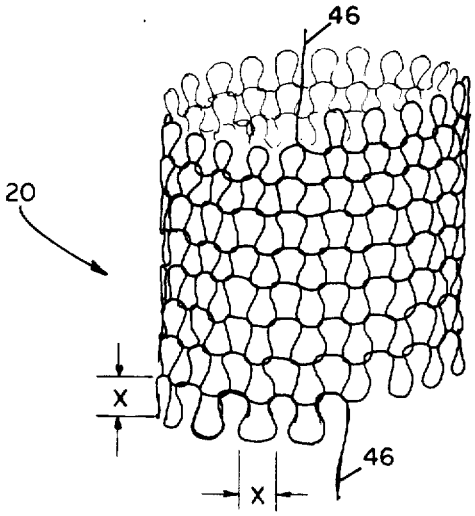
FIG. 5 is an enlarged, partial, pictorial view of an embodiment of a knitted containment mesh.

FIG. 5 is an enlarged, partial, pictorial view of an embodiment of a knitted containment mesh 20. The stitch is approximately square, as shown by approximately equal horizontal and vertical distances x on the diagram. This type of mesh may be knitted from a single strand 46 of wire or other suitable material.

Figure 6:
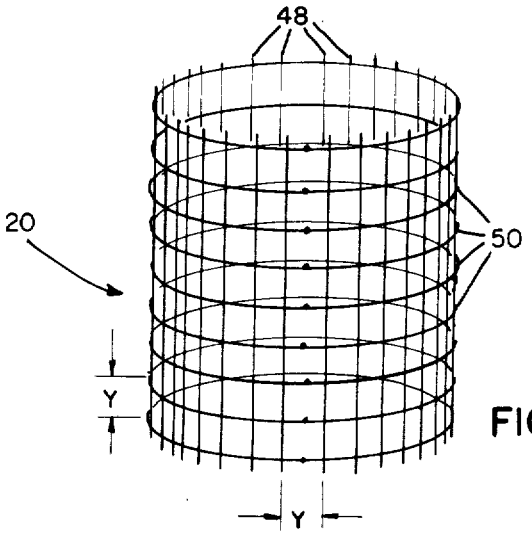
FIG. 6 is an enlarged partial, pictorial, view of an embodiment of a rigid containment mesh or screen.

FIG. 6 is an enlarged partial, pictorial view of an embodiment of a screen or rigid containment mesh 20 which may be preferred in certain embodiments of the invention. The stitch is approximately square, as shown by approximately equal horizontal and vertical distances y on the diagram. This type of mesh generally is constructed from a plurality of strands of wire or strands of other suitable material as shown by vertical strands 48 and horizontal strands 50 in the diagram.

In another alternate embodiment of the invention, the containment mesh may be imbedded in the walls of the light-source capsule.

When light-source capsules in lamps like those described in FIG. were purposely induced to burst, an additional benefit of the presence of the containment mesh was noted. The usual loud report, which may be quite startling if unanticipated, was absent. The capsules burst almost in total silence. It is believed that the absence of the loud report may be explained by the fact that the burst of the capsule was contained within the outer envelope. The atmosphere within the outer envelope was near vacuum, and the sound of the burst does not propagate through the vacuum.

Thus, there is provided a double-enveloped tungsten halogen incandescent lamp having a light-source capsule containment device which provides substantially improved operational safety characteristics.

While there have been shown and described what are at present considered to be the preferred embodiments of the invention, it will be apparent to those skilled in the art that various changes and modifications can be made herein without departing from the scope of the invention as defined by the appended claims.

I claim:

1. A double-enveloped tungsten-halogen lamp comprrising:

(a) an outer envelope;

(b) a light-source capsule;

(c) a stem on which said light-source capsule is mounted within said outer envelope, said stem having a flare which is hermetically sealed to said outer envelope;

(d) a containment mesh substantially surrounding said light-source capule for absorbing burst energy and restricting shards of said light-source capsule from shattering said outer envelope in the event said light-source capsule bursts, said containment mesh having the ability to absorb substantial energy upon deformation thereof by a cansule burst, said containment mesh having a sufficient number of stitches per inch to restrain those shards of said light-source capsule with mass large enough to cause a rupture of said outer envelope from passing through said mesh and impacting said outer envelope, said containment mesh being formed from light-reflecting metal wire and having a minimal effect on the efficacy of said lamp; and (e) mesh-mounting means for mounting said containment mesh about said light-source capsule and anchoring said mesh on said stem such that the electrical circuit of said lamp is operable.

2. A lamp as described in claim 1 wherein said light-source capsule is single-ended.

3. A lamp as described in claim 2 wherein said containment mesh is knitted.

4. A lamp as described in claim 1 wherein at least one anchoring pin is mounted on said stem and said containment mesh is mounted over said anchoring pin such that a portion of said anchoring pin is inserted through a stitch of said containment mesh.

5. A double-enveloped tungsten-halogen lamp comprising:

(a) an outer envelope;

(b) a light-source capsule;

(c) a stem on which said light-source capsule is mounted within said outer envelope, said stem having a flare which is hermetically sealed to said outer envelope;

(d) a containment mesh substantially surrounding said light-source capsule for absorbing burst energy and restricting shards of said light-source capsule from shattering said outer envelope in the event said light-source capsule bursts, said containment mesh having the ability to absorb substantial energy upon deformation therof by a capsule burst, said containment mesh having a sufficient number of stitches per inch to restrain those shards of said light-source capsule with mass large enough to cause a rupture of said outer envelope from passing through said mesh and impacting said outer envelope, said containment mesh being formed from light-reflecting metal wire and having a minimal effect on the efficacy of said lamp; and (e) mesh-mounting means for mounting said containment mesh about said light-source capsule, said mesh-mounting means including frictional forces exerted by said containment mesh itself.

6. A lamp as described in claim 5 wherein said light-source capsule is single-ended.

7. A lamp as decribed in claim 6 wherein said containment mesh is knitted.

8. A tungsten-halogen lamp comprising:

(a) an outer envelope;

(b) a single-ended light-source capsule having a top;

(c) a stem on which said light-source capsule is mounted within said outer envelope, said stem having a flare which is hermetically sealed to said outer envelope;

(d) a containment mesh substantially surrounding said light-source capsule for absorbing burst energy and restricting shards of said light-source capsule from shattering said outer envelope in the event said light-source capsule bursts, said containment mesh having the ability to absorb substantial energy upon deformation thereof by a capsule burst, said containment mesh having a sufficient number of stitches per inch to restrain those shards of said light-source capsule with mass large enough to cause a rupture of said outer envelope from passing through said mesh and impacting said outer envelope, said containment mesh being formed from light-reflecting metal wire and having a minimal effect on the efficacy of said lamp;

(e) mesh-mounting means for mounting said containment mesh operatively with respect to said light-source capsule such that the electrical circuit of said lamp is operable; and (f) collision-absorbing means mounted within said outer envelope above said top of said light-source capsule.

9. A lamp as described in claim 8 wherein said collision-absorbing means is a slightly crumpled portion of said containment mesh.

10. A lamp as described in claim 9 wherein said mesh-mounting means includes means for anchoring said containment mesh on said stem.

11. A lamp as described in claim 10 wherein said containment mesh is knitted.

12. A lamp as described in claim 8 wherein at least one anchoring pin is mounted on said stem and said containment mesh is mounted over said anchoring pin such that a portion of said anchoring pin is inserted through a stitch of said containment mesh.

* * * * *